US006637060B2

(12) United States Patent
Lu

(10) Patent No.: US 6,637,060 B2
(45) Date of Patent: Oct. 28, 2003

(54) PLIERS FOR COMPRESSION CONNECTING A CONNECTOR FOR A TELEPHONE LINE

(75) Inventor: Yu-Jung Lu, Tu Cheng (TW)

(73) Assignee: Hanlong Ind. Co., Ltd., Taiwan (CN)

( * ) Notice: Subject to any disclaimer, the term of this patent is extended or adjusted under 35 U.S.C. 154(b) by 85 days.

(21) Appl. No.: 09/970,645

(22) Filed: Oct. 5, 2001

(65) Prior Publication Data

US 2003/0066136 A1 Apr. 10, 2003

(51) Int. Cl.[7] ..... B25F 1/00
(52) U.S. Cl. ..... 7/107; 72/409.01
(58) Field of Search ..... 72/409.01, 416; 7/107, 132, 158

(56) References Cited

U.S. PATENT DOCUMENTS 4,713,874 A * 12/1987 Schwartz ..... 7/107
4,981,032 A * 1/1991 Chen ..... 7/107
5,109,591 A * 5/1992 Hung ..... 7/107
5,992,002 A * 11/1999 Hung ..... 7/107
6,173,466 B1 * 1/2001 Chen ..... 7/107

* cited by examiner

*Primary Examiner*—James G. Smith
(74) *Attorney, Agent, or Firm*—Bacon & Thomas, PLLC

(57) ABSTRACT

A pair of pliers for connecting a telephone line connector. The pliers have a compression connecting block connected with a limiting pin inserted in a limiting hole preferably of a triangular shape on one handle of the pliers. The upper edge of the limiting hole has an abutting edge bevel relative to a push guiding edge of the limiting hole. When the abutting edge contacts and presses the limiting pin, the contact point therebetween is located next to the center of the limiting pin towards the direction of an action force such that the component force of a resisting force from the center of the limiting pin towards the contact point is at the same side as that of the action force. Thus, the horizontal component force of the action force can be reduced; and the abrasion that the horizontal force component may cause on the guiding groove can be reduced.

6 Claims, 11 Drawing Sheets

PLIERS FOR COMPRESSION CONNECTING A CONNECTOR FOR A TELEPHONE LINE

BACKGROUND OF THE INVENTION

1. Field of the Invention

The present invention is related to a pair of pliers for connecting a telephone line connector by compression, and especially to a compression connecting structure capable of substantially reducing the horizontal component generated by an action force. The pliers can, in addition to obtaining a larger vertical force to connect a connector for a telephone line by compression, reduce the damage that the horizontal force component may make on a guiding groove of a compression connecting seat by abrading.

2. Description of the Prior Art

A connector of the communication line of a common communication equipment generally has the coating layer of the communication line peeled off to reveal the core lines of a suitable length. Thereafter the core lines are extended into the connector under the inserting pins of the latter so that a pair of compression connecting pliers presses the inserting pins of the connector into the connector. The bottoms of the inserting pins pierce the coating layer of the core lines to contact the core lines, and clamp the latter to complete the connection and assembly of the communication line with the connector. And as shown in FIG. 1 which is a schematic view showing a compression connecting structure for assembling a communication line with a connector, a pair of compression connecting pliers "A" are provided thereon with a pair of handles A1 to be held by an operator. The pair of handles A1 are pivotally connected by a pivot pin A2 at an appropriate position.

One of the pair of handles A1 is provided thereon with a compression connecting seat A3 for fitting over the connector, while the other of the pair of handles A1 is provided thereon with a compression connecting block A4 for inserting into the compression connecting seat A3 for pressing the connector; so that a compression clamping action of the pair of handles A1 renders the compression connecting block A4 to press fixedly for connecting the connector with the telephone line in the compression connecting seat A3.

The compression connecting seat A3 is provided on the main body thereof with a receiving seat A31 to receive the connector, and a guiding groove A32 for guiding vertical insertion of the compression connecting block A4. However, since the handles A1 move in a round path about the pivot pin A2, the compression connecting block A4 is mounted in a limiting groove A6 in one of the handles A1 by means of a limiting pin A5, and the limiting groove A6 is beveled from both the compression connecting seat A3 and the pivot pin A2, so that the lower edge of the limiting groove A6 becomes a push guiding edge A61 to push the compression connecting block A4 away from the receiving seat A31, while the upper edge of the limiting groove A6 becomes an abutting edge A62 to press the compression connecting block A4 into the receiving seat A31.

As shown in FIG. 2, when the handles A1 move outwardly, the limiting pin A5 thereof is moved by the push guiding edge A61 of the limiting groove A6 to move the compression connecting block A4 away from the receiving seat A31 of the compression connecting seat A3, so that the connector can be placed into the receiving seat A31. When the handles A1 move inwardly, the limiting pin A5 thereof is moved by the abutting edge A62 on the upper edge of the limiting groove A6 to move the compression connecting connection block A4 into the receiving seat A31 of the compression connecting seat A3. In this mode, compression connection of the connector of the telephone line is completed.

The limiting groove of a conventional pair of compression connecting pliers is a beveled elongate slot. As shown in FIGS. 2 and 3, when an operator exerts a compressing action force "F" on the handles A1 to cause the abutting edge A62 on the upper edge of the limiting groove A6 to press the limiting pin A5 and the compression connecting block A4 for compression connection, the contact point of the abutting edge A62 with the limiting pin A5 is located beside the center of the limiting pin A5 towards the pivot pin A2. The connector in the receiving seat A31 will generate a resisting force "P" by contact of the limiting pin A5 with the connector; and the resisting force may generate a component force P1 from the limiting pin A5 toward the contact point of the abutting edge A62 with the limiting pin A5.

However, since the action force "F" for compressing the handles A1 at one side of the pivot pin A2 is directed towards the compression connecting seat A3 and the end of the lower handle A1, its component force "P1" acts in a contrary direction to that of the action force "F". Further the action force "F" must form a vertical component force larger than the resisting force "P" under the limitation of the guiding groove A32, thus the action force "F" will be formed at the same time a horizontal component force larger than the component force "P1 " of the resisting force "P" is formed. Because the vertical component force of the action force "F" is used to press the compression connecting block A4 towards the receiving seat A31, but the horizontal component force of the action force is limited by the lateral edge of the guiding groove A32 from horizontal movement, the horizontal component force of the action force "F" will directly exert on one side of the guiding groove A32 to thereby increase impedance against movement of the compression connecting block A4 in the guiding groove A32, which may cause damage by abrading the guiding groove A32.

SUMMARY OF THE INVENTION

The pair of pliers for compression connecting a connector for a telephone line of the present invention has a compression connecting block connected with a limiting pin which is inserted in a limiting hole generally of a triangular shape on one of the handles. The upper edge of the limiting hole is an abutting edge bevel relative to a push guiding edge, so that when the abutting edge contacts and presses the limiting pin, the contact point between them is located beside the center of the limiting pin towards the direction where the action force is directed to, so that the component force of a resisting force from the center of the limiting pin towards the contact point of the abutting edge with the limiting pin is at the same side as that of the action force. Thereby, the horizontal component force of the action force can be reduced, since a larger vertical force can be obtained for compression connecting the compression connecting connector, and the degree of abrasion that the horizontal force component may make on the guiding groove can be reduced.

Another object of the pair of pliers for compression connecting a connector for a telephone line of the present invention is to directly mount a compression connecting seat to straddle the pair of handles and have it fixed on one of the pair of handles. The main body of the compression connecting seat is provided with an opening for insertion of the other of the pair of handles. A compression connecting block and a compression abutting block are provided respectively on the two sides of one of the handles for compression connecting by opening and closing of the pair of pliers. The handles can be both of a one-piece simple structure, and cumbersome shaping processes can be avoided. and the structure as well as the assembling operation of the whole pair of compression connecting pliers can thereby be simplified.

Another object of the pair of pliers for compression connecting a connector for a telephone line of the present invention is to provide fixedly on one of the handles of the pair of pliers a stop plate which has a stopping portion extending to the other of the handles in order to be located in the space between the handles when the handles are moved outwardly, thereby, the space between the handles provides an obscuring and stopping function to minimize resistance to the fingers of a user extended between the handles.

A further object of the pair of pliers for compression connecting a connector for a telephone line of the present invention is to provide an engaging groove at the area where the stop plate extends to the other handle, and to provide at a position corresponding to the area, a moving pin that is able to extend into the engaging groove, so that when the pair of pliers are not in use, the pliers can be pressed to close and then the moving pin is engaged into the engaging groove, so that the stop plate forms a positioning member between the handles to lock the handles of the pair of pliers in a closed state, to avoid damage by the inadvertent pressing of the handles to touch a line cutting knife.

The present invention will be apparent after reading the detailed description of the preferred embodiment thereof in reference to the accompanying drawings.

DETAILED DESCRIPTION OF THE PREFERRED EMBODIMENT

Figure 1:
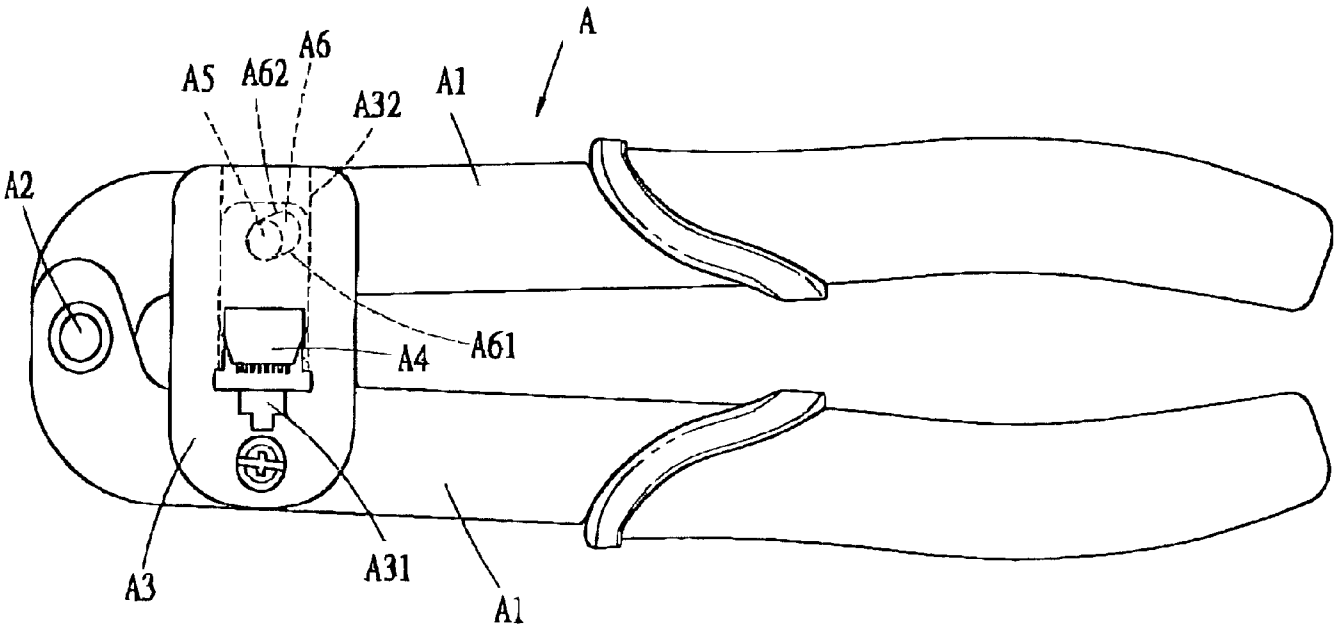
FIG.1 (PRIOR ART)
FIG. 1 is a schematic view showing the structure of a pair of conventional pliers.
Figure 2:
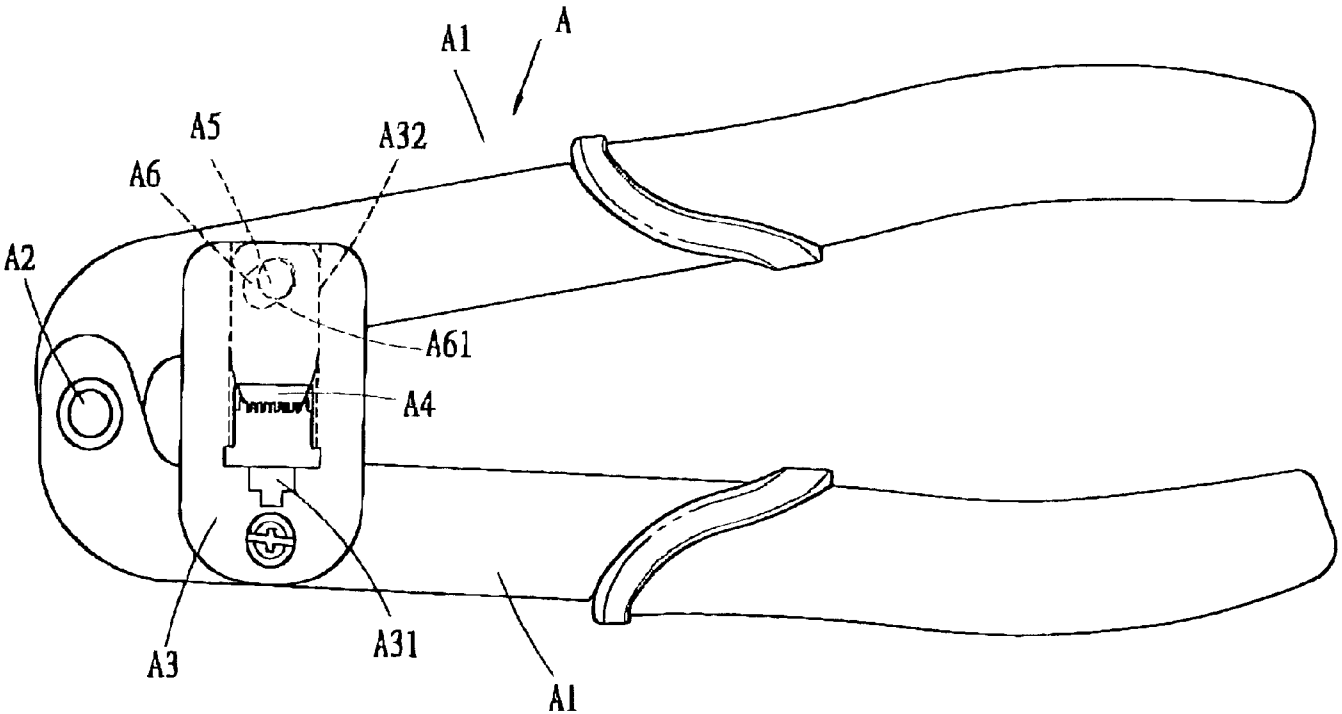
FIG.2 (PRIOR ART)
FIG. 2 is a schematic view showing the state of outwardly stretching the handles of the pair of conventional pliers.
Figure 3:
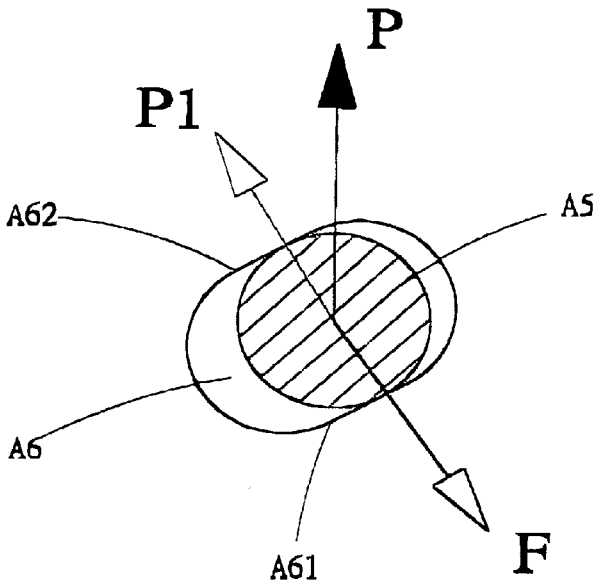
FIG.3 (PRIOR ART)
FIG. 3 is a schematic view showing the state of force bearing of a limiting pin when the pair of conventional pliers are pressed to close.
Figure 4:
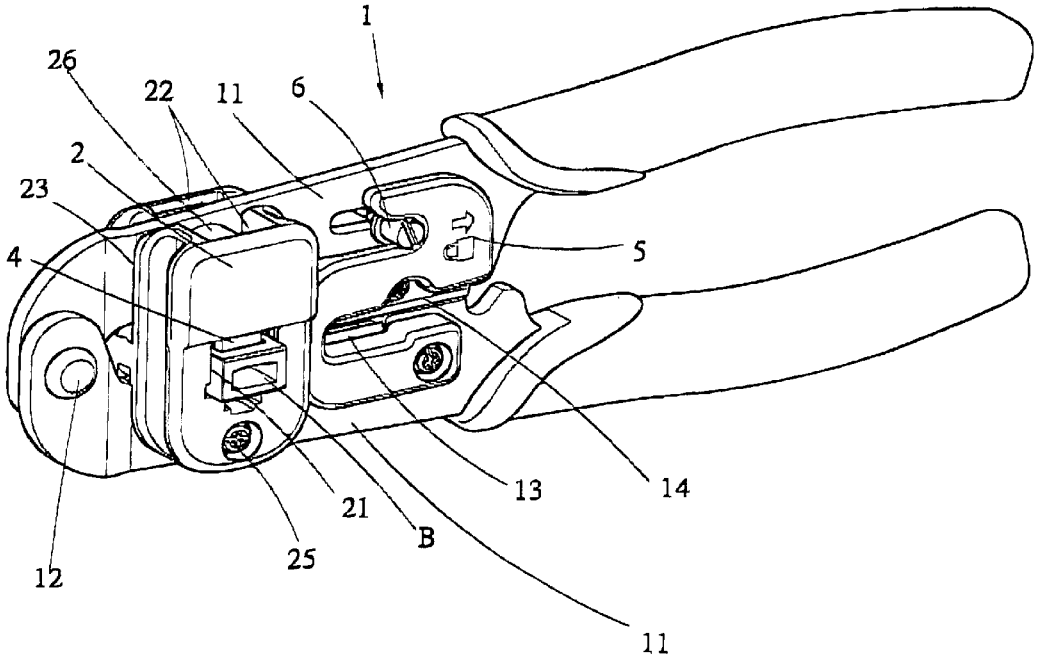
FIG. 4 is a perspective view showing the appearance of a preferred embodiment of the present invention.

The structure and arrangement of the pair of compression connecting pliers of the present invention are shown in FIG. 4, wherein, the pair of compression connecting pliers 1 is comprised of a pair of handles 11 configured for being held by a user. One end of each of the handles 11 is pivotally connected at a pivot pin 12, and a working section is provided near the joint of the handles 11. A working effect can be obtained by compressing and clamping the handles 11. The working section of the pair of compression connecting pliers 1 includes a line peeling knife 13, a compression connecting seat 2 for compression connecting inserting pins, and a line cutting knife 14. In assembling the connector of the communication line, cutting and peeling off of the coating layer of the communication line can be sequentially completed by means of the line cutting knife 14 and the line peeling knife 13, and then the compression connecting seat 2 is used to complete compression closing of the connector and the communication line.

Figure 5:
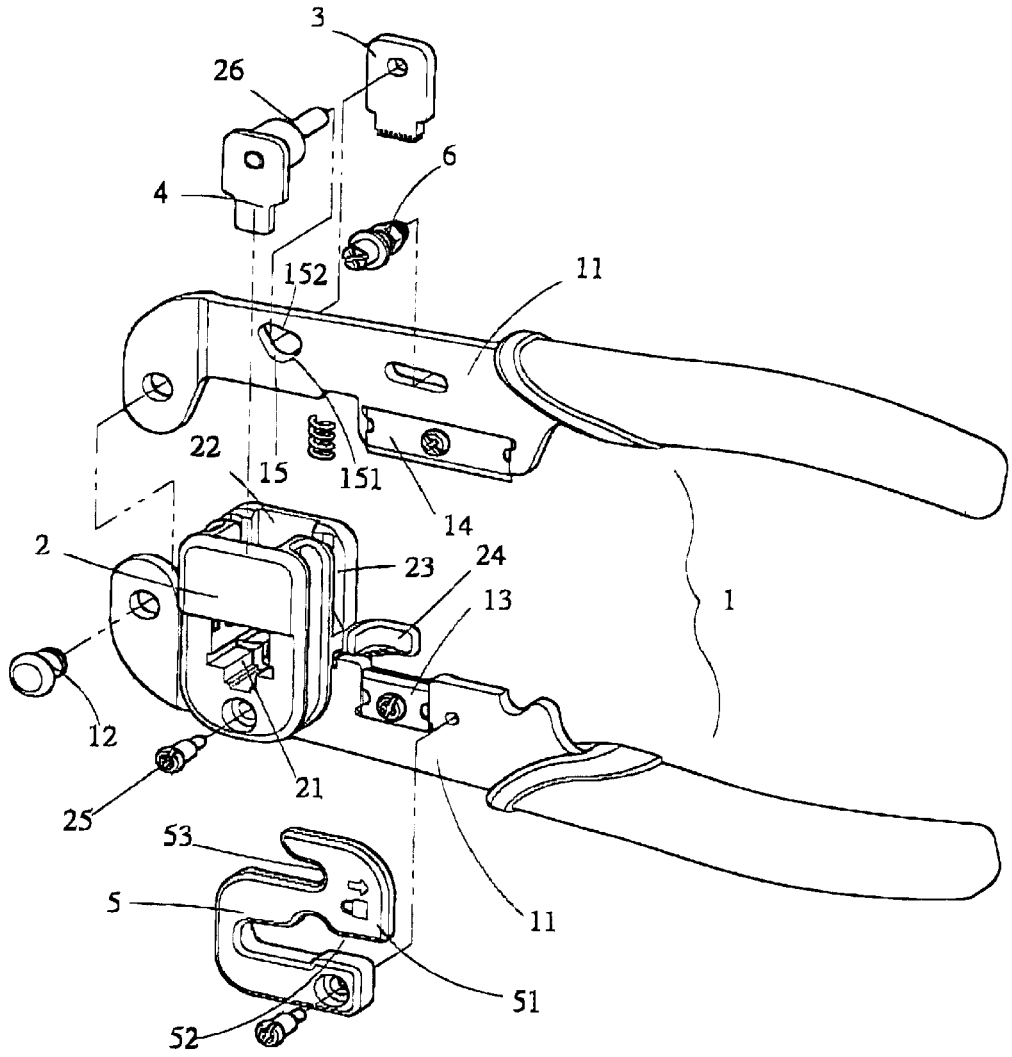
FIG. 5 is an analytical perspective view showing the structure of the pair of pliers of the present invention.

The compression connecting seat 2 is provided directly on one of the pair of handles 11 of the pair of compression connecting pliers 1 and is fixed with an inserting locking member 25. The main body of the compression connecting seat 2 can form thereon a receiving seat 21 to receive the connector "B" of a telephone line and a guiding groove 22 for vertical insertion of the receiving seat 21. The compression connecting seat can be provided with an opening 23 for insertion of the other of the pair of handles 11. Referring to FIG. 5, the opening 23 is in communication with the guiding groove 22. A compression connecting block 3 and a compression abutting block 4 that move after the opening and closing action of the handles 11 are provided respectively on the two sides of one of the pair of handles 11 and are connected with a limiting pin 26 extended through a limiting hole 15 on one of the handles 11. The compression block 3 and the compression abuitting block 4 are fitted together in the guiding groove 22. The handles 11 can each be a one-piece simple structure, to avoid any cumbersome shaping process.

Figure 6:
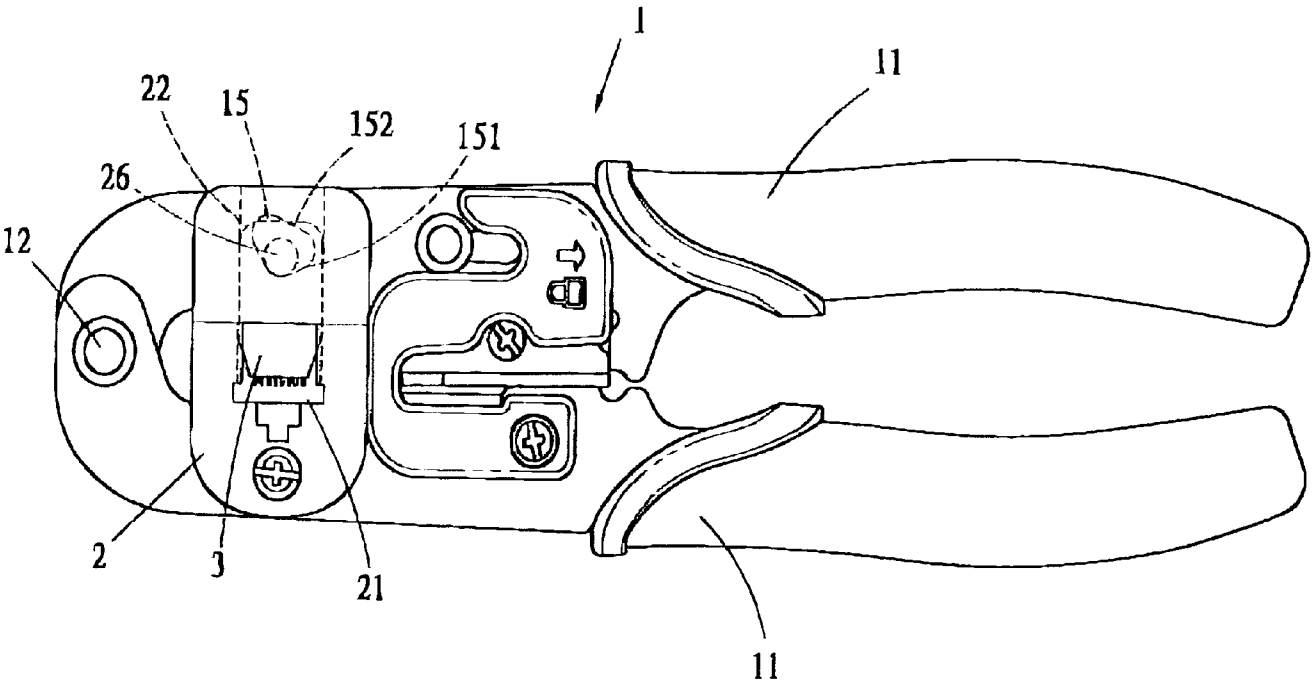
FIG. 6 is plane view showing the structure of the pair of compression connecting pliers of the present invention.
Figure 7:
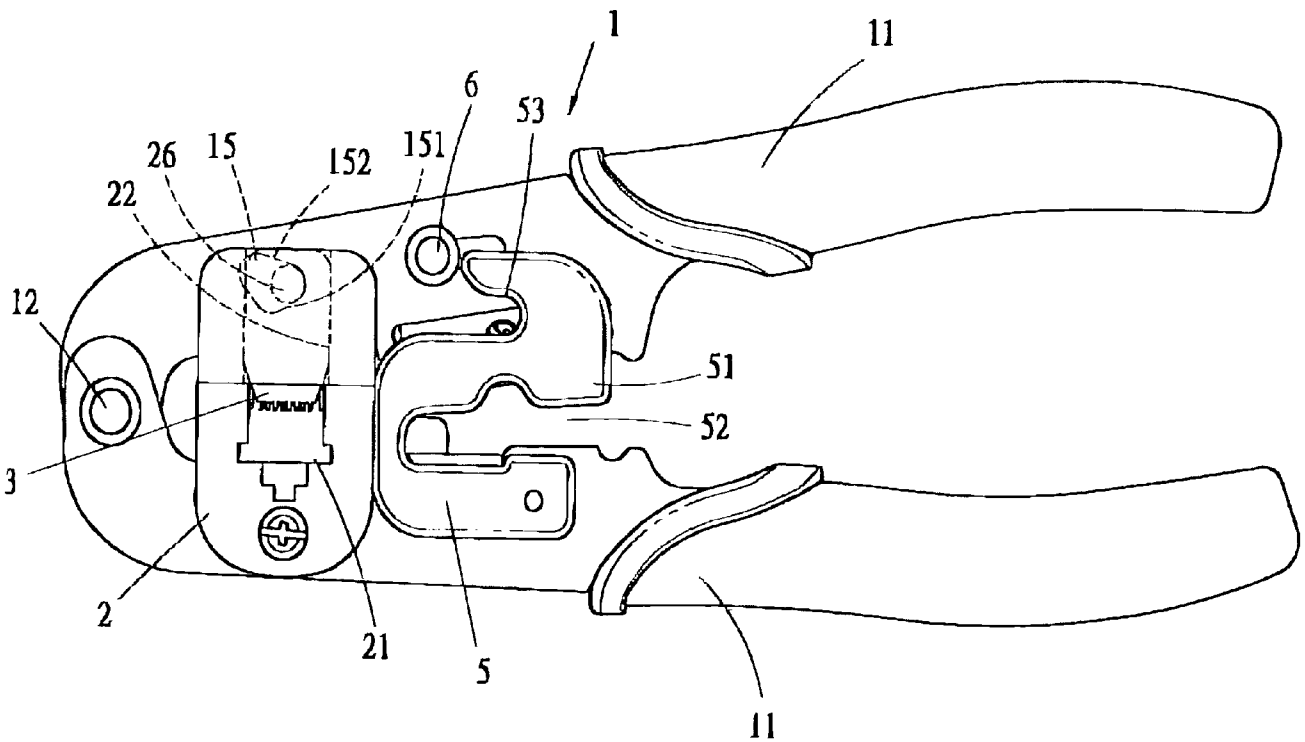
FIG. 7 is a schematic view showing the pair of compression connecting pliers of the present invention in the state of outwardly stretching.
Figure 8:
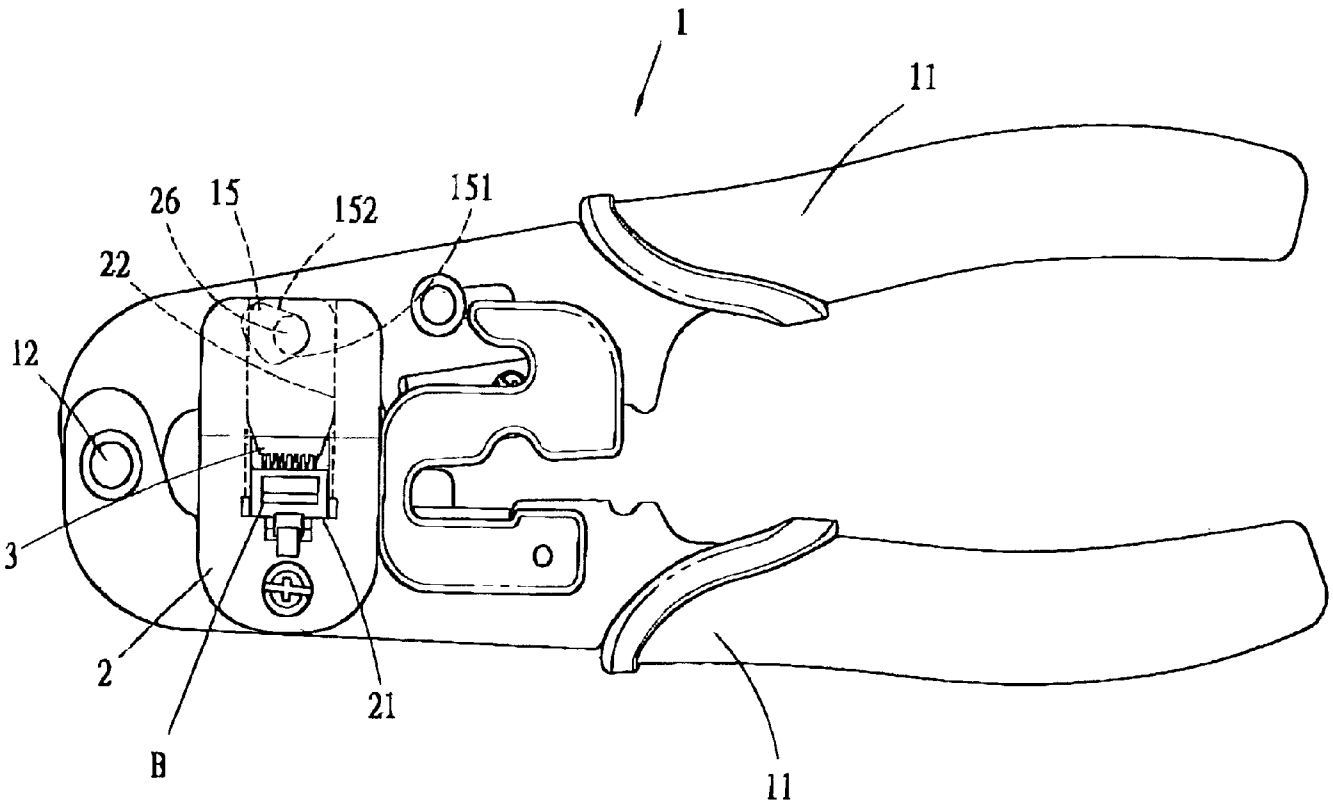
FIG. 8 is a schematic view showing fitting in of a connector of the present invention.
Figure 9:
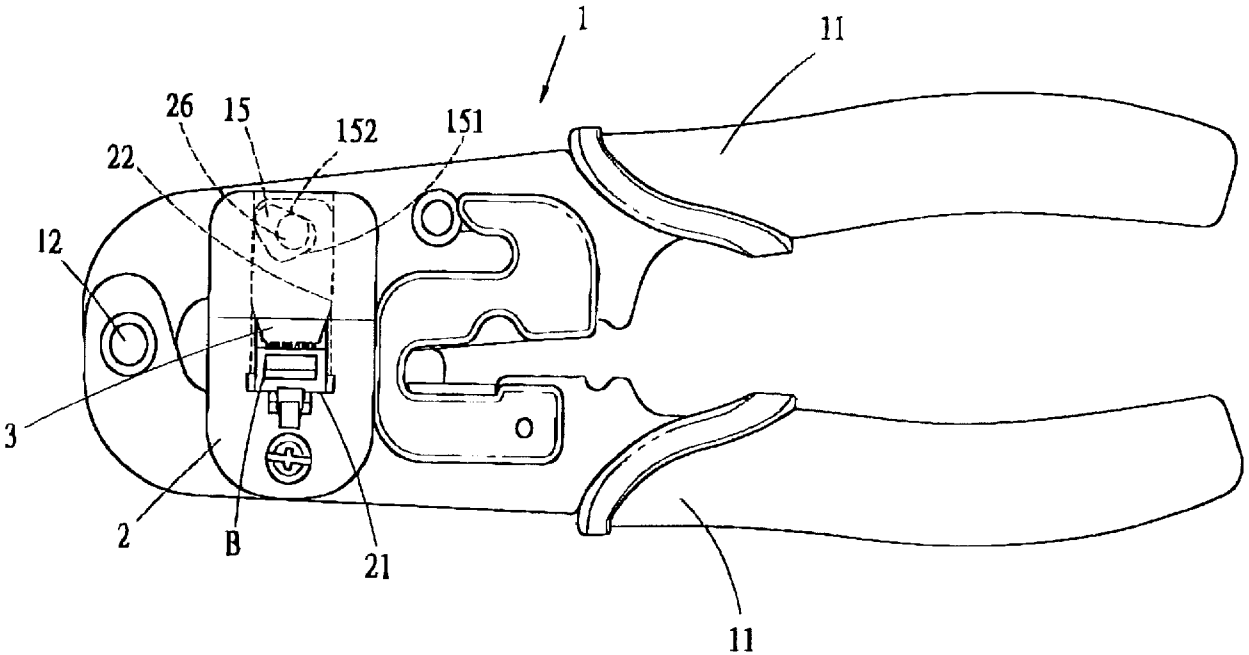
FIG. 9 is a schematic view showing the pair of compression connecting pliers of the present invention in the state of being pressed to close.
Figure 10:
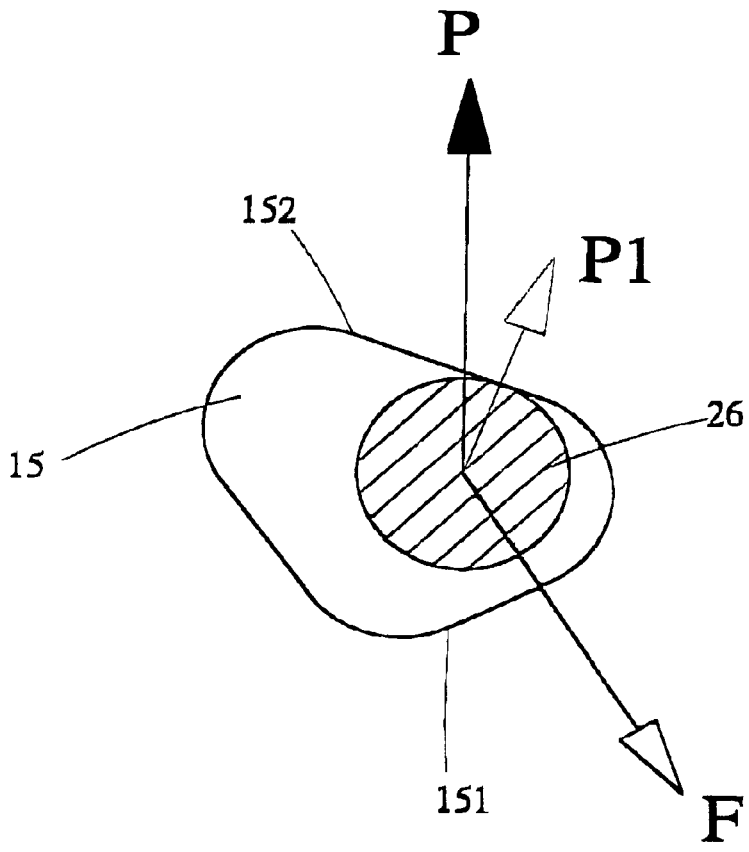
FIG. 10 is a schematic view showing the force bearing state of a limiting pin when the pair of compression connecting pliers of the present invention are pressed to close.

Referring simultaneously to FIGS. 5 and 6, the lower edge of the limiting hole 15 has a bevel push guiding edge 151 provided away from the compression connecting seat 2 and the pivot pin 12. As shown in FIG. 7, when the handles 11 are moved outwardly, the bevel push guiding edge 151 of the limiting hole 15 pushes the limiting pin 26 and in turn the compression connecting block 3 away from the receiving seat 21, so that the connector can be placed into the receiving seat 21 as shown in FIG. 8. Particularly, the upper edge of the limiting hole 15 has an abutting edge 152 slightly beveled relative to the push guiding edge 151, such as is shown in FIGS. 9 and 10, so that when the user exerts an action force "F" to compress the handles 11, the contact point of the abutting edge 152 with the limiting pin 26 is located beside the center of the limiting pin 26 towards the direction where the action force "F" directs to. Thus the component force P1 of a resisting force "P" from the center of the limiting pin 26 towards the contact point of the abutting edge 152 with the limiting pin 26 is at the same side as that of the action force "F". Thereby, the horizontal component force of the action force can be reduced, hence a larger vertical force can be obtained for compression connecting of the compression connecting connector "B", and the damage that the horizontal force component may make on the guiding groove 22 by abrading can be reduced.

Furthermore, as shown in FIGS. 5 and 7, one of the handles 11 of the pair of compression connecting pliers 1 is provided with a stop plate 5 which has a stopping portion 51 extending to the other of the handles 11. Since the line cutting knife 14 and the line peeling knife 13 both have a sharp blade, the stop plate 5 can directly be allocated at a position where the line cutting knife 14 and the line peeling knife 13 are located. The stop plate 5 is provided with a slit 52 for extending a workpiece into the space between the line cutting knife 14 and the line peeling knife 13. The main body of the stop plate 5 forms a obscuring and protection function from the blades. A stop piece 24 having specific distances respectively from the blades is formed at the side of the compression connecting seat 2 of the pair of compression connecting pliers 1 near the line cutting knife 14 and the line peeling knife 13 to form a fast positioning function for a line to be peeled of, and thereby to increase convenience of use of the pair of compression connecting pliers 1.

Figure 11:
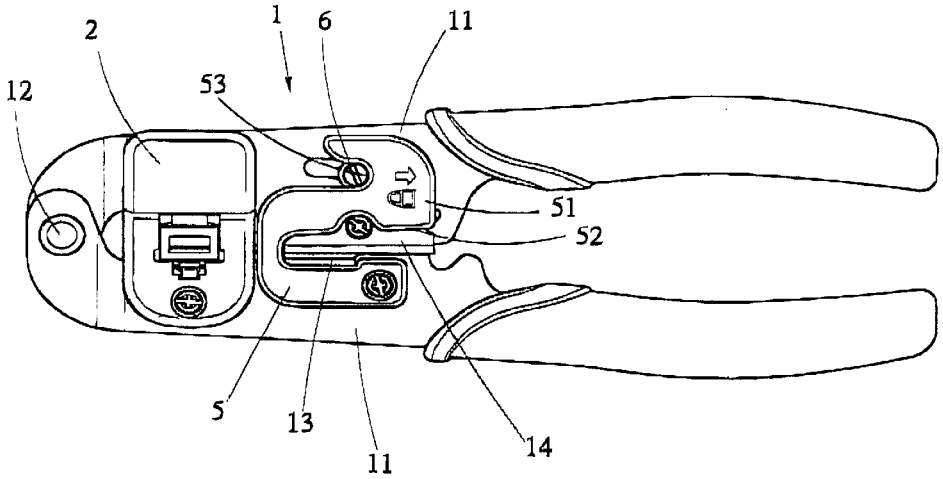
FIG. 11 is a schematic view showing the locking state of the handles of the pair of compression connecting pliers of the present invention.

A stop plate 5 is provided on a portion of one handle 11 and extends to the other handle 11 with an engaging groove 53, and at a position corresponding to this portion of the other handle 11 a moving pin 6 is able to extend into the engaging groove 53. When the pair of pliers 1 are not in use as shown in FIG. 11, the pliers 1 are pressed to close and then the moving pin 6 is engaged into the engaging groove 53, thereby the stop plate 5 forms a positioning member between the handles 11 of the pair of pliers 1 to lock the handles 11 in a closed state, and thereby avoids damage by inadvertent pressing of the handles to touch the line cutting knife 14.

The pair of pliers 1 for compression connecting the connector "B" for a telephone line of the present invention has the compression connecting block 3 connected with the limiting pin 26 which is inserted in the limiting hole 15 generally of a triangular shape on one of the handles 11. The upper edge of the limiting hole 15 is the abutting edge 152 that is bevel relative to the push guiding edge 151 so that when the abutting edge 152 contacts and presses the limiting pin 26, the contact point between them is located beside the center of the limiting pin 26 toward the direction where the action force "F" is directed to. The component force P1 of a resisting force "P" from the center of the limiting pin 26 towards the contact point of the abutting edge 152 with the limiting pin 26 is at the same side as that of the action force "F". Thereby, the horizontal component force of the action force "F" can be reduced, hence a larger vertical force can be obtained for compression connecting the compression connecting connector "B", thus the damage that the horizontal force component may make on the guiding groove 22 by abrading can be reduced. In this way, a better structure of the pair of compression connecting pliers 1 is provided.

I claim:

1. A pair of pliers for compression connecting a connector for a telephone line, comprising:

a pair of handles pivotably joined by a pivot pin;

a working section is provided near the pivot pin, said working section includes a compression connecting seat fixedly mounted on one of the handles, an other one of the handles is mounted on said working section with a compression connecting block, said compression connecting seat is provided on a main body of said working section with a receiving seat to receive a telephone line connector, and a guiding groove for guiding vertical insertion of said compression connecting block therein;

said compression connecting block is connected with a limiting pin which is inserted in a limiting hole in the other one of the handles, said limiting hole is beveled away from said compression connecting seat and said pivot pin, so that a lower edge of said limiting hole is used by said limiting pin to push said compression connecting block away from said receiving seat; and said limiting hole is a triangular shape, the upper edge of said limiting hole includes an abutting edge beveled relative to a push guiding edge thereof, so that when said abutting edge contacts and presses said limiting pin, a contact point therebetween is located besides the center of said limiting pin towards the direction where an action force is directed to, thereby a component force of a resisting force from the center of said limiting pin towards said contact point of said abutting edge with said limiting pin is at the same side as that of said action force, so that a horizontal component force of said action force is reduced, and a larger vertical force is obtained for compression connecting said compression connecting connector.

2. The pair of pliers for compression connecting a connector for a telephone line as claimed in claim 1, wherein the compression connecting seat is fixed on said one of the handles, a main body of said compression connecting seat is provided with an opening for insertion of said other one of the handles; said compression connecting block and a compression abutting block are provided respectively on two sides of said other one of the handles for compression connecting by opening and closing of said pair of pliers.

3. The pair of pliers for compression connecting a connector for a telephone line as claimed in claim 1, wherein said one of the handles is fixedly provided with a stop plate which has a stopping portion extending to said other one of the handles in order to be located in a space between said handles when the handles are moved outwardly, the space between the handles provides an obscuring and stopping function.

4. The pair of pliers for compression connecting a connector for a telephone line as claimed in claim 3, further comprising an engaging groove provided at an area where said stop plate extends to said other one of the handles, and a moving pin is able to extend into said engaging groove at a position corresponding to said area, so that when said pair of pliers are not in use, said pliers are pressed to close and said moving pin is engaged into said engaging groove to lock said handles of said pair of pliers in a closed state.

5. The pair of pliers for compression connecting a connector for a telephone line as claimed in claim 1, further comprising a line peeling knife and a line cutting knife.

6. The pair of pliers for compression connecting a connector for a telephone line as claimed in claim 5, further comprising a stop piece distanced from respective blades of said line cutting knife and said line peeling knife to form a fast positioning function for a line to be peeled off.

* * * * *